US012774567B2

(12) United States Patent
Calvert

(10) Patent No.: US 12,774,567 B2
(45) Date of Patent: Oct. 27, 2026

(54) THERMOFORMABLE OVENABLE RECYCLABLE COATED CELLULOSIC BOARD, OVENABLE RECYCLABLE COATED CELLULOSIC BOARD FOOD VESSELS THERMOFORMED THEREFROM, AND METHODS FOR MANUFACTURING AND USING THEREOF

(71) Applicant: WestRock MWV, LLC, Atlanta, GA (US)

(72) Inventor: Barry G. Calvert, Covington, VA (US)

(73) Assignee: WestRock MWV, LLC, Atlanta, GA (US)

( * ) Notice: Subject to any disclaimer, the term of this patent is extended or adjusted under 35 U.S.C. 154(b) by 186 days.

(21) Appl. No.: 17/411,942

(22) Filed: Aug. 25, 2021

(65) Prior Publication Data

US 2022/0064868 A1 Mar. 3, 2022

Related U.S. Application Data

(60) Provisional application No. 63/072,305, filed on Aug. 31, 2020.

(51) Int. Cl.

| | |
|---|---|
| ***D21J 1/08*** | (2006.01) |
| ***B65D 5/56*** | (2006.01) |
| ***B65D 81/34*** | (2006.01) |
| ***D21H 19/82*** | (2006.01) |
| ***D21H 19/84*** | (2006.01) |
| ***D21H 21/16*** | (2006.01) |
| ***D21J 3/10*** | (2006.01) |

(52) U.S. Cl.

CPC ..... *D21J 1/08* (2013.01); *B65D 5/563* (2013.01); *B65D 81/343* (2013.01); *D21H 19/82* (2013.01); *D21H 19/84* (2013.01); *D21H 21/16* (2013.01); *D21J 3/10* (2013.01)

(58) Field of Classification Search

None

See application file for complete search history.

(56) References Cited

U.S. PATENT DOCUMENTS

| | | | | | |
|---|---|---|---|---|---|
| 3,924,013 | A | | 12/1975 | Kane | |
| 4,349,124 | A | * | 9/1982 | Faller | B65D 1/44 220/608 |
| 4,455,184 | A | | 6/1984 | Thompson | |
| 4,543,280 | A | | 9/1985 | Fujita et al. | |
| 4,595,611 | A | | 6/1986 | Quick et al. | |
| 4,757,940 | A | | 7/1988 | Quick et al. | |
| 4,900,594 | A | | 2/1990 | Quick et al. | |
| 5,002,833 | A | | 3/1991 | Kinsey, Jr. et al. | |
| 5,153,061 | A | | 10/1992 | Cavagna et al. | |
| 5,203,491 | A | * | 4/1993 | Marx | A47J 37/01 220/573.1 |
| 5,421,510 | A | * | 6/1995 | Calvert | B65D 1/36 229/905 |
| 5,425,972 | A | | 6/1995 | Calvert | |
| 5,498,452 | A | * | 3/1996 | Powers | D21H 19/20 428/36.91 |
| 5,660,898 | A | | 8/1997 | Calvert | |
| 5,855,973 | A | | 1/1999 | Calvert et al. | |
| 5,968,647 | A | | 10/1999 | Adur et al. | |
| 6,068,897 | A | | 5/2000 | Adur et al. | |
| 6,103,802 | A | | 8/2000 | Zhang et al. | |
| 6,291,075 | B1 | | 9/2001 | Zhang et al. | |
| 6,740,373 | B1 | * | 5/2004 | Swoboda | D21H 27/30 428/514 |
| 8,304,003 | B1 | | 11/2012 | Sanders | |
| 8,304,004 | B2 | | 11/2012 | Sanders | |
| 8,883,237 | B2 | | 11/2014 | Sanders | |
| 2001/0036990 | A1 | * | 11/2001 | Bobsein | D21H 19/58 524/505 |
| 2002/0189538 | A1 | * | 12/2002 | Swoboda | D21H 25/12 118/235 |
| 2006/0027640 | A1 | * | 2/2006 | Smith | B65D 25/2897 206/459.5 |
| 2008/0014565 | A1 | | 1/2008 | Raumberger | |
| 2016/0348318 | A1 | * | 12/2016 | Koenig | D21H 19/54 |

FOREIGN PATENT DOCUMENTS

| | | | |
|---|---|---|---|
| WO | WO1994/026513 | A1 | 11/1994 |
| WO | 2001039968 | A1 | 6/2001 |
| WO | 2004050357 | A1 | 6/2004 |
| WO | WO2010/052671 | A2 | 5/2010 |
| WO | 2020070632 | A1 | 4/2020 |

OTHER PUBLICATIONS

Australian Patent Office, Examination report No. 1 for standard patent application, App. No. 2021331083 (Aug. 25, 2026).

* cited by examiner

*Primary Examiner* — William P Fletcher, III

(74) *Attorney, Agent, or Firm* — Neil G. Cohen; Rohini K. Garg

(57) ABSTRACT

A method for manufacturing a thermoformable ovenable coated cellulosic board includes emulsion coating an aqueous-based polymer-emulsion basecoat on a first major side of a cellulosic board substrate and emulsion coating an aqueous-based polymer-emulsion barrier topcoat on the aqueous-based polymer-emulsion basecoat.

20 Claims, 7 Drawing Sheets

THERMOFORMABLE OVENABLE RECYCLABLE COATED CELLULOSIC BOARD, OVENABLE RECYCLABLE COATED CELLULOSIC BOARD FOOD VESSELS THERMOFORMED THEREFROM, AND METHODS FOR MANUFACTURING AND USING THEREOF

PRIORITY

This application claims priority from U.S. Ser. No. 63/072,305 filed on Aug. 31, 2020, the entire contents of which are incorporated herein by reference.

FIELD

The present disclosure relates to the field of thermoformable ovenable coated cellulosic board, thermoformed ovenable coated cellulosic board food vessels, and methods for manufacturing and using thereof.

BACKGROUND

Some thermoformed ovenable coated paperboard bowls and trays of the related art have pigmented layers of heat resistant crystalized polyester (PET) extruded thereon that prevent the underlying paperboard from absorbing grease and moisture. However, the extruded polyester coatings make the containers of the related art difficult to repulp at paper recycling mills, thus inhibiting recyclability.

To improve repulpability, there have been attempts to replace extruded polyester coatings with aqueous-based coatings. In some cases, aqueous-based coated paperboard has been provided for manufacturing of folded ovenable paperboard bowls. In other cases, aqueous-based coated paperboard has been provided for manufacturing of thermoformed ovenable paperboard containers.

However, there remains need for a coating system solution to provide for an aesthetically appealing, ovenable, repulpable, coated paperboard for thermoforming into a coated paperboard container suitable and appealing for distributing, marketing, and heating of prepared food products.

Accordingly, those skilled in the art continue with research and development in the field of thermoformable ovenable coated cellulosic board, thermoformed ovenable coated cellulosic board food vessels, and methods for manufacturing and using thereof.

SUMMARY

In one embodiment, a method for manufacturing a thermoformable ovenable coated cellulosic board includes emulsion coating an aqueous-based polymer-emulsion basecoat on a first major side of a cellulosic board substrate and emulsion coating an aqueous-based polymer-emulsion barrier topcoat on the aqueous-based polymer-emulsion basecoat.

In another embodiment, a coated cellulosic board includes a cellulosic board substrate having a first major side and a second major side and a multilayer thermoformable ovenable coating. The multilayer thermoformable ovenable coating includes an aqueous-based polymer-emulsion basecoat on the first major side of the cellulosic board substrate and an aqueous-based polymer-emulsion barrier topcoat on the aqueous-based polymer-emulsion basecoat.

In yet another embodiment, a method for manufacturing a thermoformed ovenable coated cellulosic board food vessel includes thermoforming the coated cellulosic board into the form of a thermoformed ovenable coated cellulosic board food vessel.

In yet another embodiment, a coated cellulosic board food vessel includes the coated cellulosic board in the thermoformed condition.

In yet another embodiment, a method for using the thermoformed ovenable coated cellulosic board food vessel includes placing a food product on the thermoformed ovenable coated cellulosic board food vessel and sealing the food product within the thermoformed ovenable coated cellulosic board food vessel.

Other embodiments of the disclosed coated cellulosic board, thermoformed ovenable coated cellulosic board food vessel, and methods for manufacturing and using thereof, will become apparent from the following detailed description, the accompanying drawings, and the appended claims.

DETAILED DESCRIPTION

Figure 1:
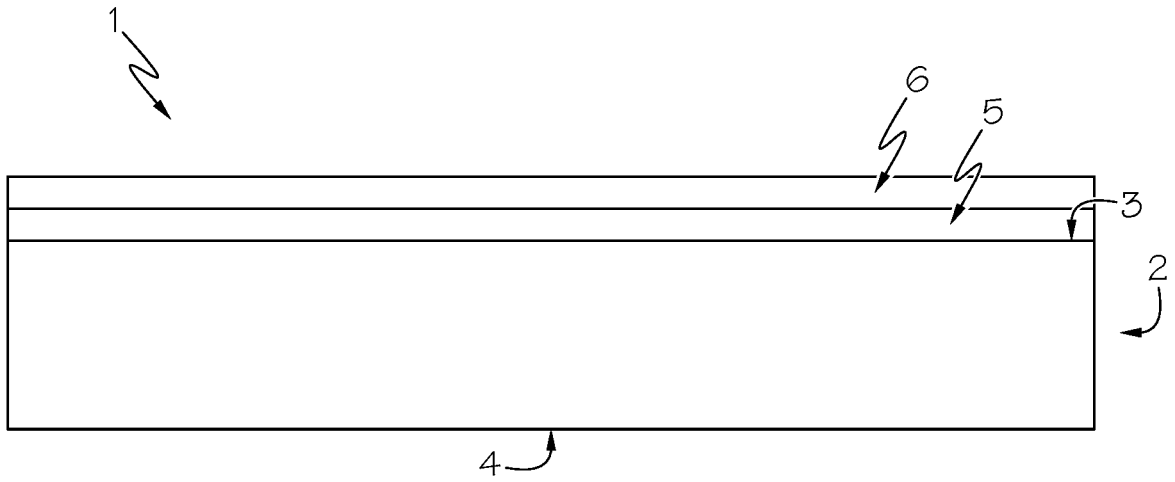
FIG. 1 is a side view representation of a coated cellulosic board (e.g. coated paperboard) according to the present description.

The present disclosure relates to coated cellulosic board substrates, particularly coated paperboard substrates. A suitable cellulosic board substrate (e.g., paperboard substrate) would preferably be selected to be ovenable to at least 400° F. and thermoformable at temperatures approximately 200-450° F. The suitable cellulosic substrate (e.g., paperboard substrate) should be selected to be recyclable and repulpable. The cellulosic board structure (e.g., paperboard substrate) may take the form of a sheet of material of a suitable size and thickness for the intended application. Hereinafter, the present disclosure will refer to paperboard substrates, but it is understood that any cellulosic board substrate suitable for the intended application may be employed.

The paperboard substrate takes the form of a web of paper-based material having a first major side and a second major side. The paperboard substrate may be formed from virgin fibers, recycled fibers, or combinations thereof. The paperboard substrate may be bleached or unbleached.

The paperboard substrate may be formed from various grades of hardwood, softwood, or combinations thereof. Preferably the paperboard substrate includes softwood fibers, which have a higher length than hardwood fibers. The long softwood fibers are more conducive to thermoforming. In an example, the paperboard substrate includes at least 1 percent, by weight, softwood fibers. In another example, the paperboard substrate includes at least 10 percent, by weight, softwood fibers. In yet another example, the paperboard substrate includes at least 20 percent, by weight, softwood fibers. In yet another example, the paperboard substrate includes at least 30 percent, by weight, softwood fibers. In yet another example, the paperboard substrate includes at least 40 percent, by weight, softwood fibers. In yet another example, the paperboard substrate includes at least 50 percent, by weight, softwood fibers. In yet another example, the paperboard substrate includes at least 60 percent, by weight, softwood fibers. In yet another example, the paperboard substrate includes at least 70 percent, by weight, softwood fibers. In yet another example, the paperboard substrate includes at least 80 percent, by weight, softwood fibers. In yet another example, the paperboard substrate includes at least 90 percent, by weight, softwood fibers.

The paperboard substrate may have any suitable thickness for the intended application. In an aspect, a paperboard substrate may have a caliper thickness in a range from about 7 point to about 30 point. In an example, the paperboard substrate has a caliper thickness in a range from about 16 point to about 24 point. A typical paperboard substrate of the present invention may be constructed from about 20 point solid bleached sulphate (SBS) sheet.

In an aspect of the present disclosure, the paperboard substrate is preferably not clay-coated on one or both of the first and second major sides. It has been found that the presence of a clay-coating on paperboard substrate, when used for thermoforming, is not ideal, as the clay-coating is prone to cracking or sticking to the heated matched metal tools used in the paperboard thermoforming process, for which the temperature of these matched metal tools can range from 200-450° F. Instead, non-clay-coated paperboard substrates have been found to be a more desirable option. The non-clay-coated paperboard substrate may be, for example, a solid bleached sulfate (SBS) substrate or an uncoated natural kraft (UNC) substrate. Typically, the paperboard substrate is most commonly a solid bleached sulfate (SBS) substrate. A suitable paperboard substrate is 20 point WestRock TruSery Pressed Tray, which is an SBS-based resilient paperboard containing softwood fibers that maintains compliance with strict global food safety standards. While uncoated paperboard substrates are suitable for the thermoforming of containers (e.g., bowls or trays), such uncoated paperboard substrates cannot by themselves contain liquids or oils, and may be unsuitable for use in the distribution of frozen or refrigerated foods. Therefore, the present description provides coatings suitable for thermoformable ovenable paperboard substrates.

The present disclosure relates to multilayer thermoformable ovenable coatings, which include an aqueous-based polymer-emulsion basecoat and an aqueous-based polymer-emulsion barrier topcoat on the aqueous-based polymer-emulsion basecoat.

Properties of the aqueous-based polymer-emulsion basecoat include that the aqueous-based polymer-emulsion coating serves as a basecoat to seal the underlying surface of the paperboard substrate and that the aqueous-based polymer-emulsion coating provides for flexibility characteristics at thermoforming temperatures. Thus, the aqueous-based polymer-emulsion basecoat functions to seal the paperboard surface and provide a flexible base for topcoat adherence during thermoforming.

The aqueous-based polymer-emulsion basecoat is preferably selected from available aqueous-based acrylic emulsion basecoats having the flexibility properties. More preferably, the aqueous-based polymer-emulsion basecoat is selected from available water-based acrylic emulsion basecoats in which no more than about 5 percent, by weight, of total polymer units of the aqueous-based polymer-emulsion basecoat are derived from acrylic acid. An exemplary available coating is Michelman Coating 2100, which is an aqueous-based, co-polymer polymer-emulsion coating having the desired flexibility characteristics. Another exemplary available coating is Michelman Coating MC40E.

The multilayer thermoformable ovenable coatings may incorporate a pigment into the aqueous-based polymer-emulsion basecoat. The pigment is preferably included in a sufficient amount to provide for substantial opacity to provide for aesthetic appeal. In another aspect of the present disclosure, the pigment is preferably a microwave-safe pigment. The pigment may have any color. For example, the pigment may typically be a black pigment, a brown pigment, or combinations thereof. The pigment may be selected from any known pigment suitable for the intended application.

The aqueous-based polymer-emulsion basecoat may be coated on one or both of the first and second major sides of the paperboard substrate.

Preferably, the aqueous-based polymer-emulsion basecoat is coated directly on, i.e., with no intervening layers, one or both of the first and second major sides of the paperboard substate.

The aqueous-based polymer-emulsion basecoat may preferably have a basis weight of about 0.5 to about 3 dry pounds per 3000 $ft^2$. If the basis weight is significantly lower than about 0.5 dry pounds per 3000 $ft^2$, then the aqueous-based polymer-emulsion basecoat may provide insufficient coverage of the paperboard substrate or may provide insufficient flexibility topcoat adherence during thermoforming. If the basis weight is significantly greater than about 3 dry pounds per 3000 $ft^2$, then the cost of the multilayer thermoformable ovenable coating may increase, the repulpability of the multilayer thermoformable ovenable coating may be inhibited, and thermoforming may be compromised because the aqueous-based polymer-emulsion basecoat becomes tacky when heated.

The topcoat is an aqueous-based barrier polymer-emulsion topcoat. Thus, the aqueous-based barrier polymer-emulsion serves as a topcoat to have resistance to blocking after thermoforming and suitability for direct contact with food during heating. The combination of the topcoat with the basecoat provides for improved blocking prevention. Two coating, i.e., basecoat plus topcoat, are better than one single coating to prevent blocking. Additionally, the aqueous-based polymer-emulsion topcoat serves a barrier layer, providing for moisture and grease barrier properties. Finally, the topcoat also acts as a slip-agent to release the food vessel from the thermoforming tooling.

The aqueous-based barrier polymer-emulsion topcoat is preferably selected from available aqueous-based acrylic emulsion topcoats having the desired barrier properties. More preferably, the aqueous-based barrier polymer-emulsion topcoat is selected from available aqueous-based acrylic emulsion basecoats in which no more than about 5 percent, by weight, of total polymer units of the aqueous-based barrier polymer-emulsion topcoat are derived from acrylic acid. An exemplary available coating is Michelman Coating 2200R, which is an aqueous-based, co-polymer emulsion coating having the desired barrier properties.

The aqueous-based barrier polymer-emulsion topcoat may be coated on one or both of the first and second major sides of the paperboard substrate. Providing the coatings on both sides of the paperboard substrate acts as a high-heat slip agent for tooling release during thermoforming as well as providing grease and moisture barrier.

Preferably, the aqueous-based barrier polymer-emulsion topcoat is coated directly on, i.e., with no intervening layers, the aqueous-based polymer-emulsion basecoat. A preferred method for coating the cellulosic board is by rod applicators.

Preferably, the aqueous-based barrier polymer-emulsion topcoat is clear. Thus, the optionally pigmented aqueous-based polymer-emulsion basecoat can be seen through the aqueous-based barrier polymer-emulsion topcoat.

The aqueous-based barrier polymer-emulsion topcoat may preferably have a basis weight of about 2 to about 10 dry pounds per 3000 $ft^2$. If the basis weight is significantly lower than about 2 dry pounds per 3000 $ft^2$, then the aqueous-based barrier polymer-emulsion topcoat may provide insufficient barrier properties. If the basis weight is significantly greater than about 10 dry pounds per 3000 $ft^2$, then the cost of the multilayer thermoformable ovenable coating may increase and the repulpability of the multilayer thermoformable ovenable coating may be inhibited.

Preferably, the aqueous-based polymer-emulsion basecoat and the aqueous-based polymer-emulsion barrier topcoat have a combined basis weight of about 2.5 to about 12 dry pounds per 3000 $ft^2$. If the combined basis weight is significantly greater than about 12 dry pounds per 3000 $ft^2$, then the cost of the multilayer thermoformable ovenable coating may increase and the repulpability of the multilayer thermoformable ovenable coating may be inhibited.

By combining the basecoat and the topcoat of the present disclosure into a multilayer thermoformable ovenable coating, the present disclosure provides for a thermoformable, ovenable, repulpable, coated paperboard suitable for thermoforming into a thermoformed, ovenable, repulpable, coated paperboard container suitable for distributing, marketing, and heating of prepared food products.

Properties of the multilayer thermoformable ovenable coating include: (a) mass stability at temperatures below about 400° F., i.e., below 400° F. the coatings will not melt, degrade, or otherwise lose mass (for instance, by a solvent outgassing); (b) capable of being tack bonded at temperatures of about 250° F. or greater; (c) chloroform-soluble extractives levels do not exceed about 0.5 $mg/in^2$ of food contact surface when exposed to a food simulating solvent, for example, N-Heptane at 150° F. for two hours; and (d) is flexible enough to withstand conventional creasing in a cross direction with a 2 point male rule and 0.62 inch channel while sustaining a crack length ratio, defined as total length of cracks per total length of score, of no greater than about 0.1; and (e) exhibits resistance to blocking when stacked at ambient conditions under a load of about 0.5 $lbs/in^2$ or greater; and (f) is resilient enough for thermoforming at temperatures ranging from about 200° F. to about 450° F. without degradation or damage. These properties are important because they assure that the multilayer coating will not crack during thermoforming, contaminate the food in contact with the coating during storage and use of the food vessel, and the blanks or food vessel can be separated by conventional feed systems.

Mass stability may be determined by a Thermal Gravimetric Analysis (TGA) plot, which is a measure of the weight of a coating sample plotted against temperature. Any significant weight loss indicates product outgassing. By way of the term "ovenable," it is understood that the coatings of the present description have mass stability at temperatures below about 400° F., i.e., below about 400° F. the coatings will not melt, degrade, or otherwise lose mass (for instance, by a solvent outgassing).

As further mentioned below, a film (e.g., a PET lidstock film) may be tack bonded at temperatures of 250° F. or greater to the multilayer thermoformable ovenable coating to seal a food vessel thermoformed therefrom. One of the aspects of the multilayer thermoformable ovenable coating is capability of being tack bonding at temperatures of 250° F. or greater to the aqueous-based polymer-emulsion barrier topcoat.

Chloroform-soluble extractives levels may be determined by an extraction test, which measures non-transfer of substances from the package to the food product. Coated paperboard may be tested by use of an extraction cell described in the "Official Methods of Analysis of the Association of Official Analytical Chemists," 13th Ed. (1980) sections 21.010-21.015, under "Exposing Flexible Barrier Materials for Extraction." A suitable food simulating solvent for tray applications described would be N-Heptane. The N-Heptane should be a reagent grade, freshly redistilled before use, using only material boiling at 208° F. The extraction methodology consists of, first, cutting the lid sample to be extracted to a size compatible with the clamping device chosen. Next, the sample to be extracted is placed in the device so that the solvent only contacts the food contact surface. The solvent is then added to the sample holder and placed in an oven for two hours at 150° F. At the end of the exposure period, the test cell is removed from the oven and the solvent is poured into a clean PYREX® flask or beaker being sure to rinse the test cell with a small quantity of clean solvent. The food-simulating solvent is evaporated to about 100 millimeters in the container, and transferred to a clean, tared evaporating dish. The flask is washed three times with small portions of the Heptane solvent and the solvent is evaporated to a few millimeters on a hot plate. The last few millimeters should be evaporated in an oven maintained at a temperature of approximately 221° F. The evaporating dish is cooled in a desiccator for 30 minutes. A chloroform extraction is then performed by adding 50 milliliters of reagent grade chloroform to the residue. The mix is warmed, filtered through a Whatman No. 41 filter paper in a PYREX® funnel and the filtrate is collected in a clean, tared evaporating dish. The chloroform extraction is then repeated by washing the filter paper with a second portion of chloroform. This filtrate is added to the original filtrate and the total is evaporated down to a few millimeters on a low temperature hot plate. The last few millimeters should be evaporated in an oven maintained at approximately 221° F. The evaporating dish is cooled in a desiccator for 30 minutes and weighed to the nearest 0.1 milligram to get the chloroform-soluble extractives residue. To be assured that there is no appreciable coating transfer to the food product, the chloroform-soluble extractives should not exceed about 0.5 $mg/in^2$.

Flexibility of the multilayer thermoformable ovenable coating may be determined by using iodine to stain scored areas. The coated paperboard is subjected to conventional creasing in a cross direction with a 2 point male rule and 0.62 inch channel. Iodine is applied to stain scored areas. The iodine technique makes any cracks in the applied coating extremely visible. Cracking on each score is then evaluated as to average crack size and coverage (lengthwise) over a one-inch score area. The crack length ratio, defined as total length of cracks per total length of score, of no greater than about 0.1 is measured.

Blocking resistance of the multilayer thermoformable ovenable coating is important when blanks or trays are stacked at ambient temperatures under a load of about 0.5 lbs./sq. in. or greater. Blanks or food vessels of the present disclosure may be stacked after manufacture of the blanks or food vessels. Typically, blanks may be cased (approximately 1000/case) or palletized. The pallets are then stacked creating fairly high (0.5 lbs/in$^2$) loads on the bottom layers of blanks. Food vessels may be "nested" and delivered and shipped in a similar manner. When the food vessels or blanks are unpacked by an end user they are typically loaded into a mechanical devise which separates the articles and transfers them to a conveyer or sealing device. If the blanks or food vessels have any attraction to one another, the aqueous-based polymer-emulsion barrier topcoat must have the necessary properties which allows for easy separation.

The resiliency of the multilayer thermoformable ovenable coating for thermoforming at temperatures about 200 to about 450° F. without degradation or damage as a result of the thermoforming processes. It was found that the aqueous-based polymer-emulsion basecoat alone, i.e., without a topcoat, does not provide resiliency of the multilayer thermoformable ovenable coating for thermoforming at temperatures about 200 to about 450° F. without degradation or damage. To the contrary, the aqueous-based polymer-emulsion basecoat alone, i.e., without a topcoat, result is sticking of basecoat to the thermoforming tools.

With reference to FIG. 1, there is illustrated a side view of an exemplary coated cellulosic board (e.g., coated paperboard). The coated paperboard 1 includes a thermoformable ovenable uncoated paperboard substrate 2 having a first major side 3 and a second major side 4, a continuous coating of a dried aqueous-based polymer-emulsion basecoat 5 directly on the first major side 3 of the paperboard substrate 2, and a continuous coating of a dried aqueous-based polymer-emulsion barrier topcoat 6 directly on the dried aqueous-based polymer-emulsion basecoat 5. The second major side 4 may or may not have its own inks or coatings. For example, the outside surface may include one or both of the aqueous-based polymer-emulsion basecoat and the aqueous-based polymer-emulsion barrier topcoat.

The present disclosure relates to methods for manufacturing thermoformable ovenable coated cellulosic boards (e.g. coated paperboards), including steps of emulsion coating the aqueous-based polymer-emulsion basecoat on the first major side of the cellulosic board substrate (e.g. paperboard substrate) and emulsion coating an aqueous-based polymer-emulsion barrier topcoat on the aqueous-based polymer-emulsion basecoat.

The emulsion coating steps may be performed by any suitable methods, such as by use of a gravure roll, a flex-coater, a rod coater, an air knife, or a screen blade. A preferred method for coating the cellulosic board is by rod applicators. The step of emulsion coating the aqueous-based polymer-emulsion basecoat and the step of emulsion coating an aqueous-based polymer-emulsion barrier topcoat may employ the same coating method or may employ different coating methods. Rod coating is a preferred embodiment of the present disclosure for both the step of emulsion coating the aqueous-based polymer-emulsion basecoat and the step of emulsion coating an aqueous-based polymer-emulsion barrier topcoat.

In an aspect, the step of emulsion coating the aqueous-based polymer-emulsion basecoat comprises emulsion coating the aqueous-based basecoat to a basis weight of about 0.5 to about 3 dry pounds per 3000 ft$^2$. In another aspect, the step of emulsion coating the aqueous-based polymer-emulsion barrier topcoat comprising emulsion coating the aqueous-based polymer-emulsion barrier topcoat to a basis weight of about 2 to about 10 dry pounds per 3000 ft$^2$. In yet another aspect, the aqueous-based polymer-emulsion basecoat and the aqueous-based polymer-emulsion barrier topcoat have a combined basis weight of about 2.5 to about 12 dry pounds per 3000 ft$^2$.

The step of emulsion coating the aqueous-based polymer-emulsion basecoat may include emulsion coating the aqueous-based polymer-emulsion basecoat on the second major side of the cellulosic board substrate (e.g. paperboard substrate).

The step of emulsion coating the aqueous-based polymer-emulsion barrier topcoat may include emulsion coating the aqueous-based polymer-emulsion barrier topcoat on a second major side of the cellulosic board substrate (e.g., paperboard substrate). For example, the step of emulsion coating the aqueous-based polymer-emulsion barrier topcoat may include emulsion coating the aqueous-based polymer-emulsion barrier topcoat on the aqueous-based polymer-emulsion basecoat on the second major side of the cellulosic board substrate.

In an aspect, the step of emulsion coating aqueous-based polymer-emulsion basecoat on the second major side of the cellulosic board substrate may include emulsion coating aqueous-based basecoat to a basis weight of about 0.5 to about 3 dry pounds per 3000 ft$^2$. In another aspect, the step of emulsion coating the aqueous-based polymer-emulsion barrier topcoat on the second major side of the cellulosic board substrate may include emulsion coating the aqueous-based polymer-emulsion barrier topcoat to a basis weight of about 2 to about 10 dry pounds per 3000 ft$^2$. In yet another aspect, the aqueous-based polymer-emulsion basecoat and the aqueous-based polymer-emulsion barrier topcoat on the second major side of the cellulosic board substrate may have a combined basis weight of about 2.5 to about 12 dry pounds per 3000 ft$^2$.

Figure 2:
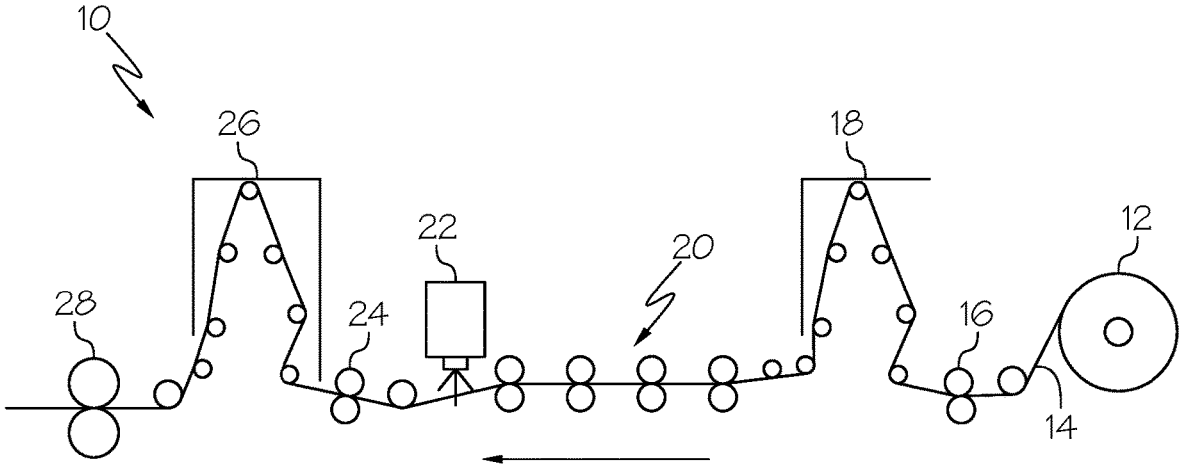
FIG. 2 is a schematic illustration of an apparatus for producing rolls or sheets of coated cellulosic board (e.g., coated paperboard) of the present description. A preferred method for coating the cellulosic board is by rod applicators.

FIG. 2 illustrates a schematic illustration of an exemplary apparatus 10 for producing rolls or sheets of coated cellulosic board (e.g., coated paperboard) of the present description, in particular a reel handling system 10. This illustration depicts production of coated paperboard blanks. In particular, the apparatus 10 may include a paper roll 12, a paperboard substrate 2 in the form of a paperboard roll web 14, a first coating station 16, a first coating dryer 18, printing station 20, curing station 22, a second coating station 24, a second coating dryer 26, cutters 28, resulting in coated paperboard blanks. A preferred method for coating the cellulosic board is by rod applicators.

During the operation of apparatus 10, paper roll 12 is unrolled such that paperboard roll web 14 is formed. Paperboard roll web 14 is traversed along apparatus 10 by conventional techniques to first coating station 16. At the first coating station 16, paperboard roll web 14 is coated with the aqueous-based polymer-emulsion basecoat 5 of the present description on the first major side 3 of the paperboard roll web 14. The aqueous-based polymer emulsion basecoat 5 may be continuously applied or patterned applied at the first coating station 16 on the first major side 3 of the paperboard roll web 14 by any conventional coating technique (e.g., a gravure roll, a flex-coater, a rod coater, an air knife, a screen blade) mentioned earlier at a deposition rate of, preferably, about 0.5 to about 3 dry pounds per 3000 ft$^2$ for the basecoat 5. Rod coating is a preferred embodiment of the present disclosure. Following the application of the aqueous-based polymer-emulsion basecoat 5 upon paperboard roll web 14, paperboard roll web 14 is traversed to a first coating dryer 18 where the aqueous-based polymer-emulsion basecoat is dried. After drying, the paperboard roll web 14 may be cooled through contact with conventional drum chillers (not shown). The paperboard roll web 14 is traversed to graphics printing station 20 where graphics such as sales and information graphics as well as other inks or coatings may be applied upon paperboard roll web 14. Inks may then cured at curing station 22. For example, radiation curable inks may be applied at graphics printing station 20 and cured at curing station 22. After curing the inks, the paperboard roll web 14 is traversed along apparatus 10 by conventional techniques to second coating station 24. At the second coating station 24, paperboard roll web 14 is coated with the aqueous-based polymer-emulsion barrier topcoat 6 of the present description on the aqueous-based polymer-emulsion basecoat 5. The aqueous-based polymer-emulsion barrier topcoat 6 may be continuously applied or patterned applied at the second coating station 24 by any conventional coating technique (e.g., a gravure roll, a flex-coater, a rod coater, an air knife, a screen blade) mentioned earlier at a deposition rate of, preferably, about 2 to about 10 dry pounds per 3000 $ft^2$ for the topcoat. Rod coating is a preferred embodiment of the present disclosure. Following the application of the aqueous-based polymer-emulsion barrier topcoat 6 upon paperboard roll web 14, paperboard roll web 14 is traversed to a second coating dryer 26 where the aqueous-based polymer-emulsion barrier topcoat 6 is dried. The process depicted in FIG. 2 is illustrated as continuous, but the process can be broken into steps at the same or different facilities. FIG. 2 is only one exemplary sequence as related to the application of the basecoat 5, topcoat 6, and optional graphics of the present description. Following the application of basecoat 5 and topcoat 6, paperboard roll web 14 is traversed to cutting mechanism 28 which cuts the paperboard roll web 14 into the desired blank size and scores the blank to provide desired score lines (e.g., radial score lines) for subsequent thermoforming. For example, the cutting mechanism may be a rotary cutting system. Alternatively, one may choose to wind the paperboard roll web 14 in roll form or sheet the web for cutting and scoring at a later time.

Figure 3:
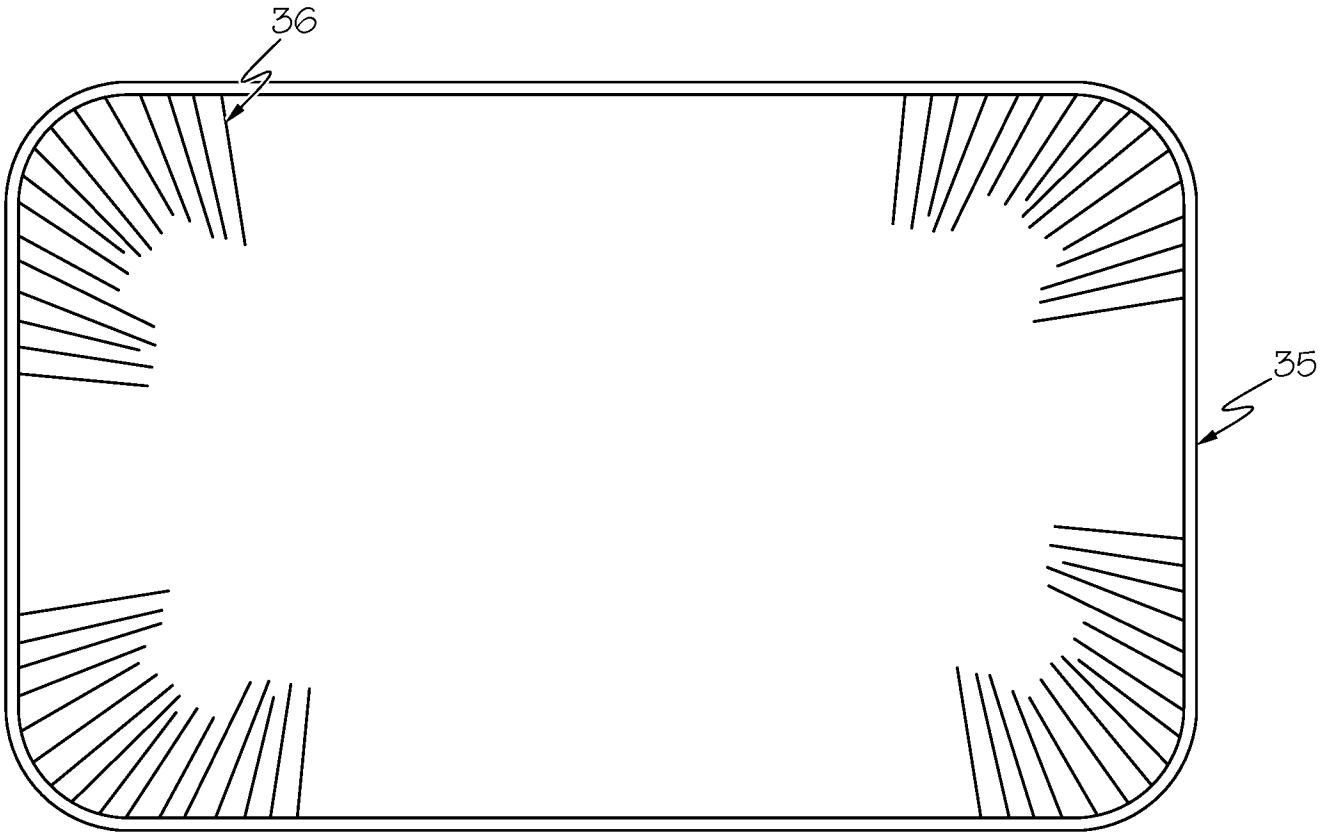
FIG. 3 is a top view of a coated cellulosic board according to the present description in the form of a blank having radial score lines.

The present disclosure relates to coated cellulosic board substrates in the form of a blank. FIG. 3 is a top view of an exemplary coated cellulosic board according to the present description in the form of a blank 35 having radial score lines 36 suitable for thermoforming. The blank 35 has multiple score lines 36 that are close together at each corner of the blank 35. The score lines 36 enable for the formation of pleats that result when the blank 35 is thermoformed. The coating of the present description do not crack or otherwise get damaged when the scores 36 become pleats to ensure for the desired barrier properties. The illustrated score lines 36 are one exemplary representation of radial score lines. Actual scoring may be more or less.

The present disclosure relates to methods for manufacturing a thermoformed ovenable coated cellulosic board food vessel, in which the coated cellulosic board as previously described is thermoformed into the form of a thermoformed ovenable coated cellulosic board food vessel.

The thermoforming may be performed in any conventional manner. For example, thermoforming may be performed using thermoforming machines manufactured by Peerless Machine or Gralex Industries. A specific exemplary thermoforming process is described as follows.

Figure 6:
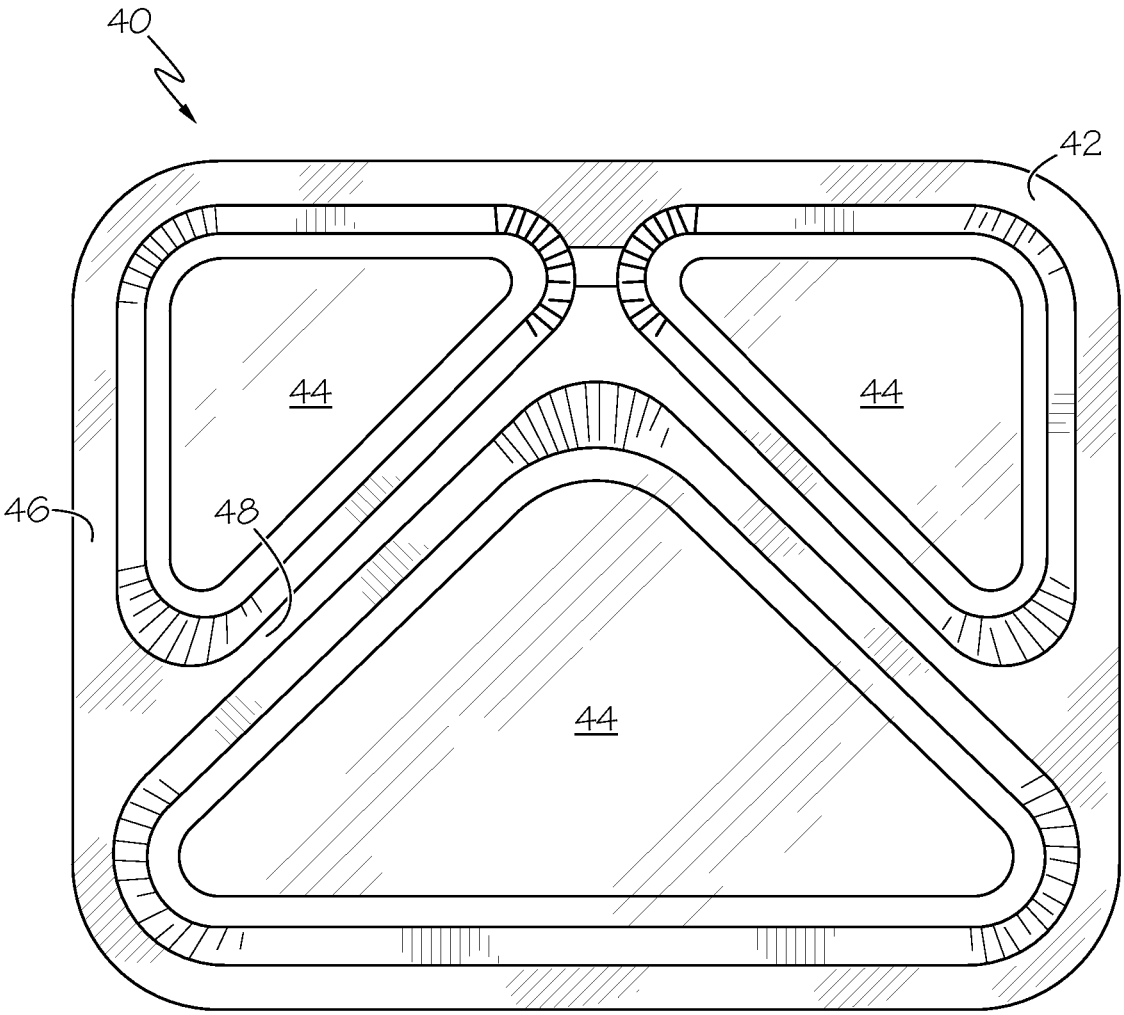
FIG. 6 is a pictorial view of a thermoformed paperboard food vessel with multiple cavities having been coated on the inside panels according to the present invention.
Figure 7:
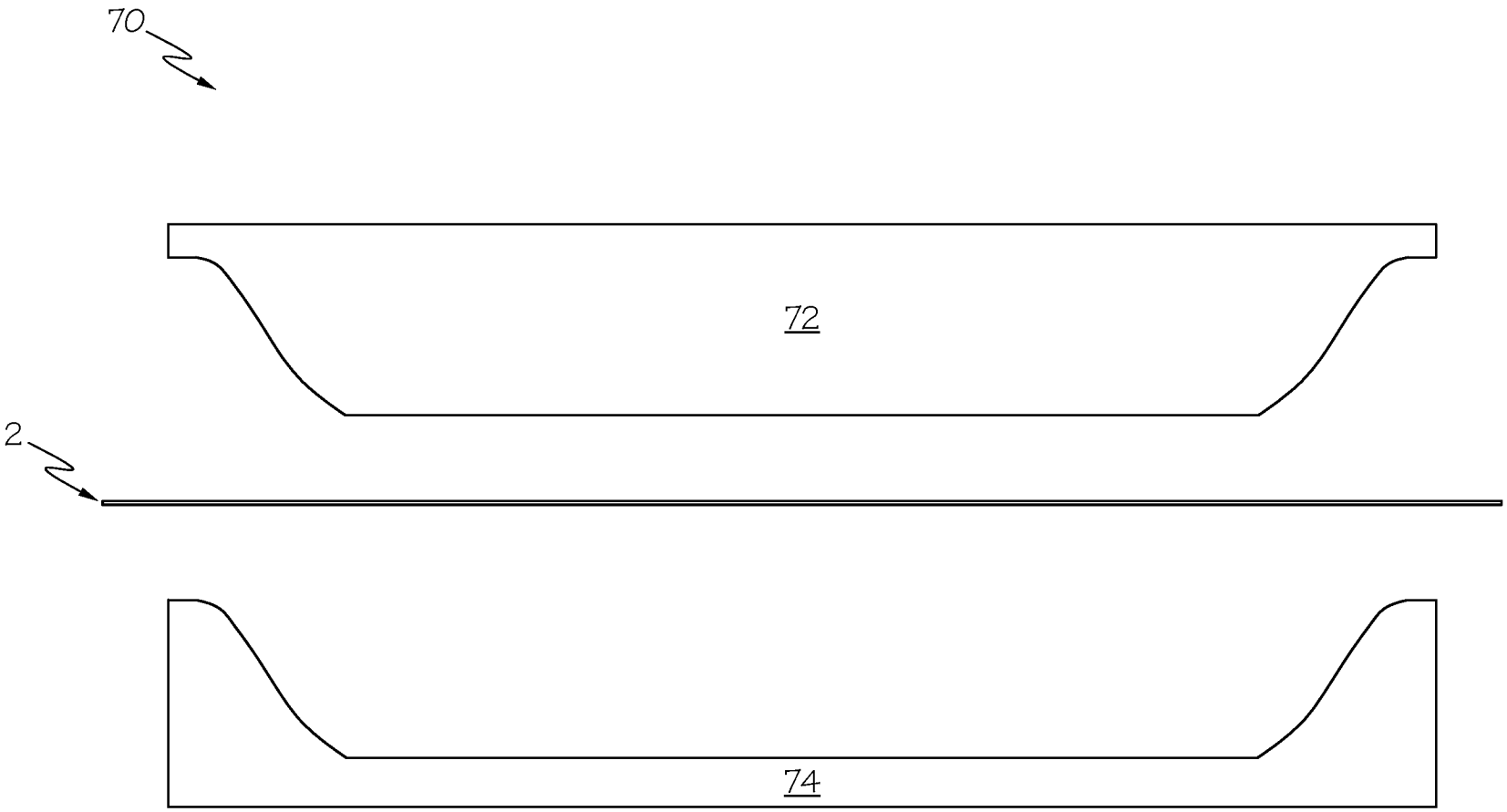
FIG. 7 is a side view representation of a paperboard thermoforming process of the present description.

Typically, a web of coated paperboard to be thermoformed into a paperboard food vessel are blanked and scored and delivered to a thermoforming press 70 as a stack of blanks. FIG. 6 is schematic representation of a cross-section of a male die 72 and a female die 74 of the thermoforming press 70 used for thermoforming the paperboard blank 2 into a paperboard food vessel (e.g., tray or bowl). It will be understood that the male die 72 and the female die 74 as illustrated in FIG. 6 are merely exemplary, and that thermoforming systems may include a variety of modifications and alternatives including but not limited dividers and cavities.

At the thermoforming press 70, the paperboard blank 2 is thermoformed with the male die 72 and the female die 74 using heat and pressure to form a paperboard food vessel.

Thus, the paperboard blank 2 is heated, drawn into the temperature-controlled female die 74 by the temperature-controlled male die 72, and then held against the surfaces of the male die 72 and female die 74 until cooled.

The temperature of the female-die 74 is controlled to be at a higher temperature than the male die 72. The first major side 3 of the paperboard substrate 2 is arranged to face the male die 72 and the second major side 4 of the paperboard substrate 1 is arranged to face the female die 74.

If the temperature of the male die 72 is too low, then the basecoat 5 and topcoat 6 as well as the paperboard substrate 2 may be insufficiently heated and the resulting paperboard food vessel may not be strongly formed to the desired shape. If the temperature of the male die 72 is too high, then the basecoat 5 and/or topcoat 6 may stick to the male die 72. Accordingly, in an aspect, the male die 72 preferably has a temperature of approximately 110-220° F. If the paperboard substrate 2 were to have clay coating that substrate may stick in the thermoform tooling. In an aspect, the female die may have a temperature of approximately 200-450° F.

In an aspect, a moisture content of the coated paperboard 1 is controlled during the thermoforming process. The moisture content may be controlled by, for example, using a humidifier to control an atmospheric humidity or addition of moisture directly to the coated paperboard.

If the moisture content of the coated paperboard 1 is too high, then blistering of the basecoat 5 and/or topcoat 6 may occur. If the moisture content of the coated paperboard 1 is too low, then corner cracking of the paperboard substrate 2 and the basecoat 5 and/or topcoat 6 may occur. In an aspect, the moisture of the coated paperboard 1 is controlled between 9 and 14 percent, by weight. In another aspect, the moisture of the coated paperboard 1 is controlled between 10 and 13 percent, by weight.

The present disclosure relates to coated cellulosic board food vessels. The coated cellulosic board food vessels are thermoformed from the previously described coated cellulosic board. The thermoforming may be performed in any manner, such by way of the thermoforming methods described above.

The structure of the coated cellulosic board food vessels is not limited. In an aspect, the coated cellulosic board food vessel may include a coated bottom panel and a coated sidewall panel. In another aspect, the coated cellulosic board food vessel may include a coated bottom panel, a coated sidewall panel, and a coated flange panel.

Figure 4:
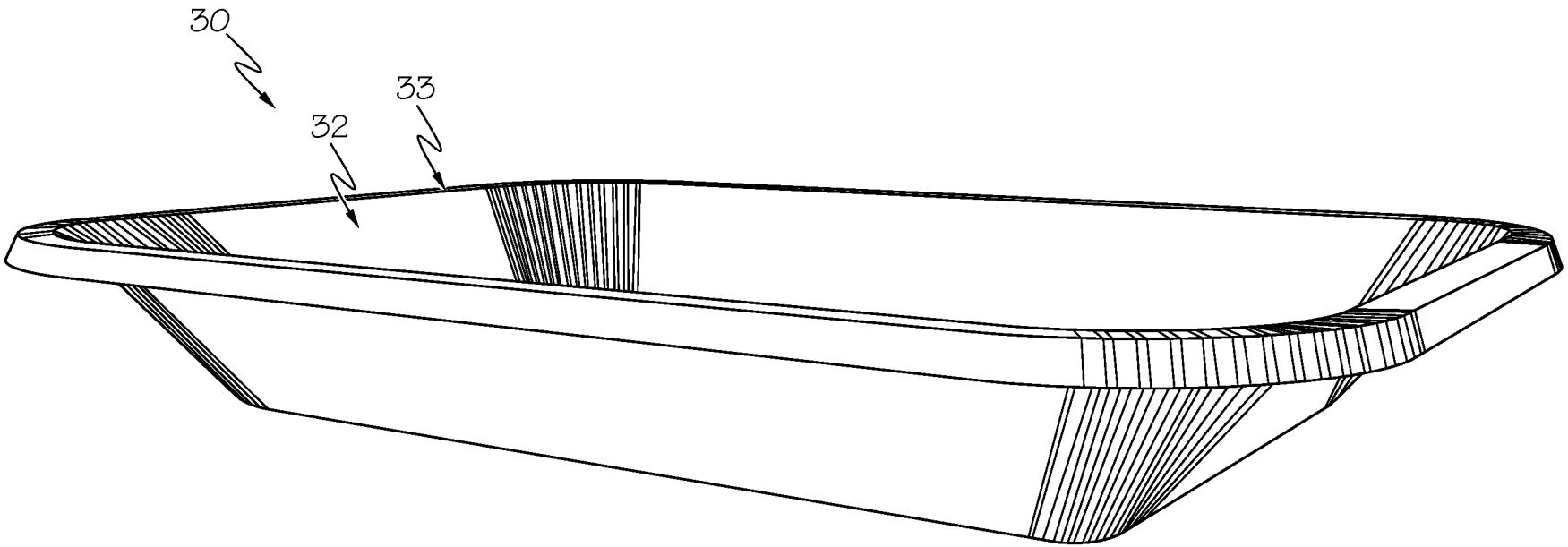
FIG. 4 is a pictorial view of a thermoformed paperboard food vessel (e.g. tray) having been coated on the inside panels according to the present description.

An exemplary food vessel in the form of a food tray is illustrated in FIGS. 3 and 4. With reference to FIG. 3, there is illustrated a thermoformed paperboard food tray 30. Food tray 30 may include in part, a coated bottom panel 31, coated sidewall panel 32, and a coated flange panel 33. The coated panels may be comprised of the coated paperboard sheet 1 of FIG. 1. The coated flange panel 23 can be tack bonded to PET lidstock film or similar at temperatures of 250° F. or greater. FIG. 4 is an alternate view of the same food tray 30 and constituent panels 31, 32, 33.

Figure 5:
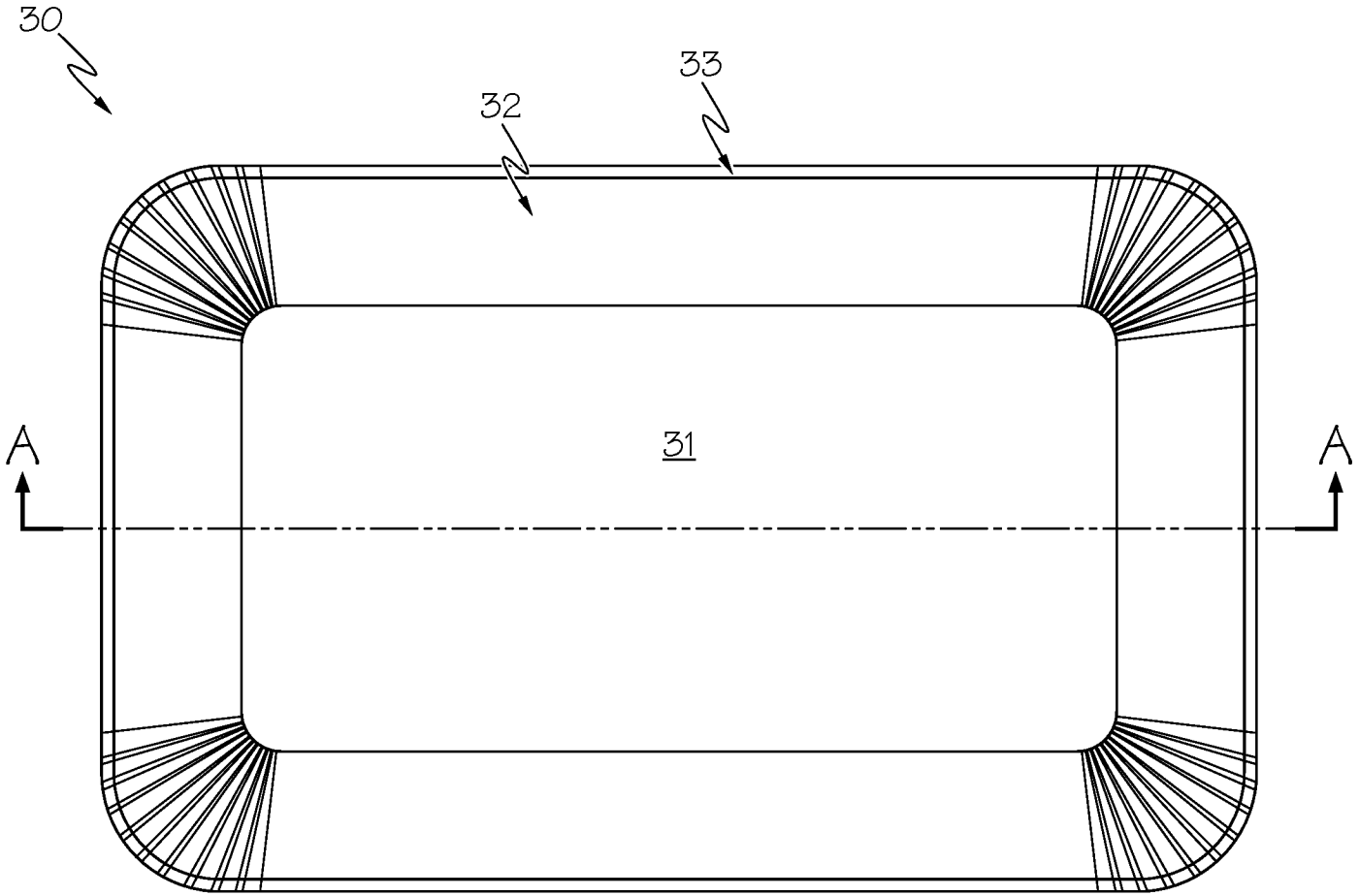
FIG. 5 is an alternate pictorial view of the same thermoformed paperboard food vessel of FIG. 4.

An exemplary food vessel in the form of a food tray is illustrated in FIG. 5. With reference to FIG. 5, food tray 40 may include in part, tray compartments 44, flange 46 and top surface 48. The top surface 48 may correspond to the first major side 3 (having basecoat 5 and topcoat 6) in FIG. 1. The coated flange panel 46 can be tack bonded to PET lidstock film or similar at temperatures of 250° F. or greater. The food tray 40 in FIG. 5 may be cut from a paperboard sheet or web of a great length.

The present disclosure relates to methods of using coated cellulosic board food vessels. In an aspect, a method of using the coated cellulosic board food vessels as previously describe may include placing a food product on the thermoformed ovenable coated cellulosic board food vessel and sealing the food product within the thermoformed ovenable coated cellulosic board food vessel.

The sealing of the food product within the thermoformed ovenable coated cellulosic board food vessel may be performed by any suitable conventional method. In an exemplary aspect, the sealing of the thermoformed ovenable coated cellulosic board food vessel may include tack bonding a film to the thermoformed ovenable coated cellulosic board food vessel, particularly a flange of the thermoformed ovenable coated cellulosic board food vessel.

Although various embodiments of the disclosed coated cellulosic board, thermoformed ovenable coated cellulosic board food vessel, and methods for manufacturing and using thereof, have been shown and described, modifications may occur to those skilled in the art upon reading the specification. The present application includes such modifications and is limited only by the scope of the claims.

What is claimed is:

1. A method for manufacturing a container, comprising:

emulsion coating an aqueous-based acrylic polymer-emulsion basecoat on a first major side of a non-clay-coated cellulosic board substrate comprising at least 20% by weight softwood fibers to a basis weight of about 0.5 to about 3 dry pounds per 3000 $ft^2$, wherein the aqueous-based acrylic polymer-emulsion basecoat comprises a pigment;

emulsion coating an aqueous-based acrylic polymer-emulsion barrier topcoat on the aqueous-based acrylic polymer-emulsion basecoat to a basis weight of about 2 to about 10 dry pounds per 3000 $ft^2$ to yield a coated cellulosic board, wherein the aqueous-based polymer-emulsion barrier topcoat is clear; and thermoforming the coated cellulosic board into a shape of the container wherein the first major side of the non-clay-coated cellulosic board substrate defines an interior surface of the container, wherein the thermoforming is at a temperature of about 200 to about 450° F., wherein the thermoforming comprises drawing the coated cellulosic board into a female die using a male die, wherein the first major side of the non-clay-coated cellulosic board substrate is arranged to face the male die and the second major side of the non-clay-coated cellulosic board substrate is arranged to face the female die, and wherein the temperature of the female die is controlled to be at a higher temperature than the male die.

2. The method of claim 1, wherein the cellulosic board substrate comprises at least 30% by weight softwood fibers.

3. The method of claim 1, wherein the cellulosic board substrate comprises at least 40% by weight softwood fibers.

4. The method of claim 1, wherein the aqueous-based acrylic polymer-emulsion basecoat and the aqueous-based acrylic polymer-emulsion barrier topcoat together have a combined basis weight of about 2.5 to about 12 dry pounds per 3000 $ft^2$.

5. The method of claim 1, wherein no more than about 5 percent, by weight, of total polymer units of the aqueous-based acrylic polymer-emulsion basecoat are derived from acrylic acid.

6. The method of claim 1, wherein no more than about 5 percent, by weight, of total polymer units of the aqueous-based acrylic polymer-emulsion barrier topcoat are derived from acrylic acid.

7. The method of claim 1, wherein the pigment comprises a black pigment, a brown pigment, or a combination thereof.

8. The method of claim 1, wherein the aqueous-based acrylic polymer-emulsion basecoat is further coated on a second major side of the non-clay-coated cellulosic board substrate.

9. The method of claim 8, wherein the aqueous-based acrylic polymer-emulsion barrier topcoat is further coated on the aqueous-based acrylic polymer-emulsion basecoat on the second major side of the non-clay-coated cellulosic board substrate.

10. The method of claim 1, further comprising scoring the coated cellulosic board prior to the thermoforming.

11. The method of claim 1, further comprising radially scoring the coated cellulosic board prior to the thermoforming.

12. The method of claim 1, wherein the thermoforming is performed at a moisture content of the coated cellulosic board between about 9% and about 14% by weight.

13. The method of claim 1, wherein the thermoforming forms a food tray having a bottom panel, a sidewall panel, and a flange panel.

14. The method of claim 1, wherein after the thermoforming, the coated cellulosic board has a crack length ratio of no greater than about 0.1.

15. The method of claim 1, further comprising tack bonding a film lid to the container at a temperature of about 250° F. or greater.

16. The method of claim 1, wherein the container comprises a plurality of tray compartments, wherein the plurality of tray compartments are separated by dividers formed during the thermoforming.

17. The method of claim 1, wherein the aqueous-based acrylic polymer-emulsion barrier topcoat functions as a release layer to reduce sticking to thermoforming tooling.

18. The method of claim 1, wherein the aqueous-based acrylic polymer-emulsion barrier topcoat functions as a slip agent during thermoforming.

19. The method of claim 1, wherein the pigment is present in an amount sufficient to provide opacity.

20. The method of claim 1, further comprising printing graphics on the coated cellulosic board prior to thermoforming.

* * * * *